US009370258B1

(12) United States Patent
vom Scheidt, Jr. et al.

(10) Patent No.: US 9,370,258 B1
(45) Date of Patent: Jun. 21, 2016

(54) ELECTROMOTIVE FORCE-BASED CONTROL SYSTEM FOR A CHILD SWING

(71) Applicant: Mattel, Inc, El Segundo, CA (US)

(72) Inventors: Peter vom Scheidt, Jr., Elma, NY (US); James P. Meade, Hamburg, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/476,983

(22) Filed: Sep. 4, 2014

Related U.S. Application Data

(60) Provisional application No. 61/876,817, filed on Sep. 12, 2013.

(51) Int. Cl.
*H02P 6/18* (2016.01)
*A47D 13/10* (2006.01)
*A63G 9/16* (2006.01)

(52) U.S. Cl.
CPC ..... *A47D 13/105* (2013.01); *A63G 9/16* (2013.01)

(58) Field of Classification Search
CPC ..... A63G 9/16; A63G 9/00; F16H 21/38; H02P 6/182; H02P 6/085
USPC ..... 318/400.01, 400.14, 400.15, 700, 701, 318/721, 779, 799, 432, 400.32, 400.33, 318/400.34; 472/118, 119, 123, 125, 135; 160/336; 193/16; 414/695
See application file for complete search history.

(56) References Cited

U.S. PATENT DOCUMENTS

| | | | | |
|---|---|---|---|---|
| 4,038,588 | A | 7/1977 | Woolfson et al. | |
| 4,785,678 | A * | 11/1988 | McGugan | A47D 13/105 185/40 C |
| 5,525,113 | A | 6/1996 | Mitchell et al. | |
| 6,339,304 | B1 | 1/2002 | Allison et al. | |
| 6,561,915 | B2 | 5/2003 | Kelly et al. | |
| 6,814,670 | B2 | 11/2004 | Morita et al. | |
| 7,354,352 | B2 | 4/2008 | Keska et al. | |
| 7,563,170 | B2 | 7/2009 | Bellows et al. | |
| 7,874,927 | B2 * | 1/2011 | Godiska | 472/119 |
| 7,883,426 | B2 | 2/2011 | Bellows et al. | |
| 7,884,710 | B2 | 2/2011 | Godiska et al. | |
| 7,905,791 | B2 | 3/2011 | Guang et al. | |
| 7,918,742 | B2 * | 4/2011 | Clapper et al. | 472/119 |
| 8,029,377 | B2 | 10/2011 | Velderman et al. | |
| 8,187,111 | B2 | 5/2012 | Velderman et al. | |
| 8,342,977 | B2 * | 1/2013 | Ting et al. | 472/119 |
| 2005/0283908 | A1 | 12/2005 | Wong et al. | |
| 2007/0277309 | A1 | 12/2007 | Shane et al. | |
| 2008/0136236 | A1 | 6/2008 | Kincaid et al. | |
| 2008/0146359 | A1 | 6/2008 | Godiska | |
| 2008/0146361 | A1 | 6/2008 | Godiska | |
| 2009/0151069 | A1 | 6/2009 | Shane et al. | |
| 2011/0256943 | A1 | 10/2011 | Yeh et al. | |

FOREIGN PATENT DOCUMENTS

WO 2008131449 A2 10/2008

* cited by examiner

*Primary Examiner* — Antony M Paul
(74) *Attorney, Agent, or Firm* — Edell, Shapiro & Finnan, LLC

(57) ABSTRACT

A control system for a child swing comprising a swing arm mechanically coupled to a motor. The control system is configured to monitor electromotive force (EMF) generated by the motor at an input signal line and is configured to use the monitored EMF to control a speed of the motor.

26 Claims, 9 Drawing Sheets

250

ELECTROMOTIVE FORCE-BASED CONTROL SYSTEM FOR A CHILD SWING

CROSS-REFERENCE TO RELATED APPLICATION

This application claims priority to and is based on U.S. Patent Application No. 61/876,817, filed Sep. 12, 2013, entitled "Electromotive Force-Based Control System for a Child Swing," the entire disclosure of which is incorporated herein by reference in its entirety.

FIELD OF THE INVENTION

The present invention generally relates to an electromotive force-based (EMF-based) control system for a child swing.

BACKGROUND OF THE INVENTION

Child swings are commonly used to entertain children (e.g., infants). Traditionally, a child swing includes a seat which is supported at the distal end of one or more swing arms. The swing arms are configured to swing so that the seat follows an arcuate path.

Various mechanisms (e.g., motors, magnets, etc.) have been proposed to power child swings so that there is no need for a parent or other user to continuously keep the swing in motion. In motor driven swings, an electric motor is mechanically coupled to a swing arm via a drive mechanism such that a torque output by the motor causes a swinging motion of the swing arm.

Child swings generally include a user interface that allows a user to select one of a plurality of swing angle (i.e., seat height) settings. In the case of a motor driven swing, the motor may be provided with a predetermined voltage input that is generated based on the user's selection. The voltage level provided to the motor determines the speed of the motor and the resulting torque placed on the swing arm, thereby determining the resulting angle of the swing.

SUMMARY OF THE INVENTION

Embodiments of the present invention relates to a control system for a child swing comprising a motor and at least one swing arm mechanically coupled to the motor such that torque output by the motor imparts force on the swing arm. The control system is configured to monitor electromotive force (EMF) generated by the motor and to use the monitored EMF to control a speed of the motor.

In one embodiment, a drive mechanism mechanically couples the motor to the swing arm such that the motor experiences variable loading conditions. The control system is configured to use the monitored EMF to detect changes in loading conditions of the motor and to adjust the speed of the motor in response to the changes in loading conditions such that the drive mechanism remains substantially in-phase with the swing arm.

In one embodiment, the control system is configured to drive the motor at the input signal line with a pulse width modulation (PWM) drive signal comprising a plurality of drive pulses, and wherein the control system is configured to adjust the duty cycle of the drive signal in response to the monitored EMF.

In one embodiment, to adjust the duty cycle of the drive signal in response to the monitored EMF, the control system is configured to store values corresponding to the EMF monitored from the input signal line for a period of time following a drive pulse, calculate an average EMF value from the EMF values stored during the period of time, subtract the average EMF value from an predetermined voltage value to generate an offset value, and use the offset value as an index into a look-up table to select a new duty cycle for the drive signal.

In one embodiment, the control system is configured to use the monitored EMF to determine if the child swing has experienced a stall condition where predetermined arcuate motion of the swing arm has been disrupted.

In one embodiment, if the child swing has experienced a stall condition, the control system is configured to store values corresponding to the EMF monitored from the input signal line for a period of time following each of a plurality of drive pulses, for each of the plurality of drive pulses, calculate an average EMF value for the EMF values stored during the period of time following a corresponding drive pulse, calculate, using the average EMF values calculated for each of the plurality of drive pulses, a long-term average EMF value, and compare the long-term average EMF value to upper and lower stall limits.

In one embodiment, if the long-term average EMF value is above the upper stall limit or below the lower stall limit, the control system is configured to enter a stabilization routine.

BRIEF DESCRIPTION OF THE DRAWINGS

Like reference numerals have been used to identify like elements throughout this disclosure.

DETAILED DESCRIPTION OF THE INVENTION

Figure 1:
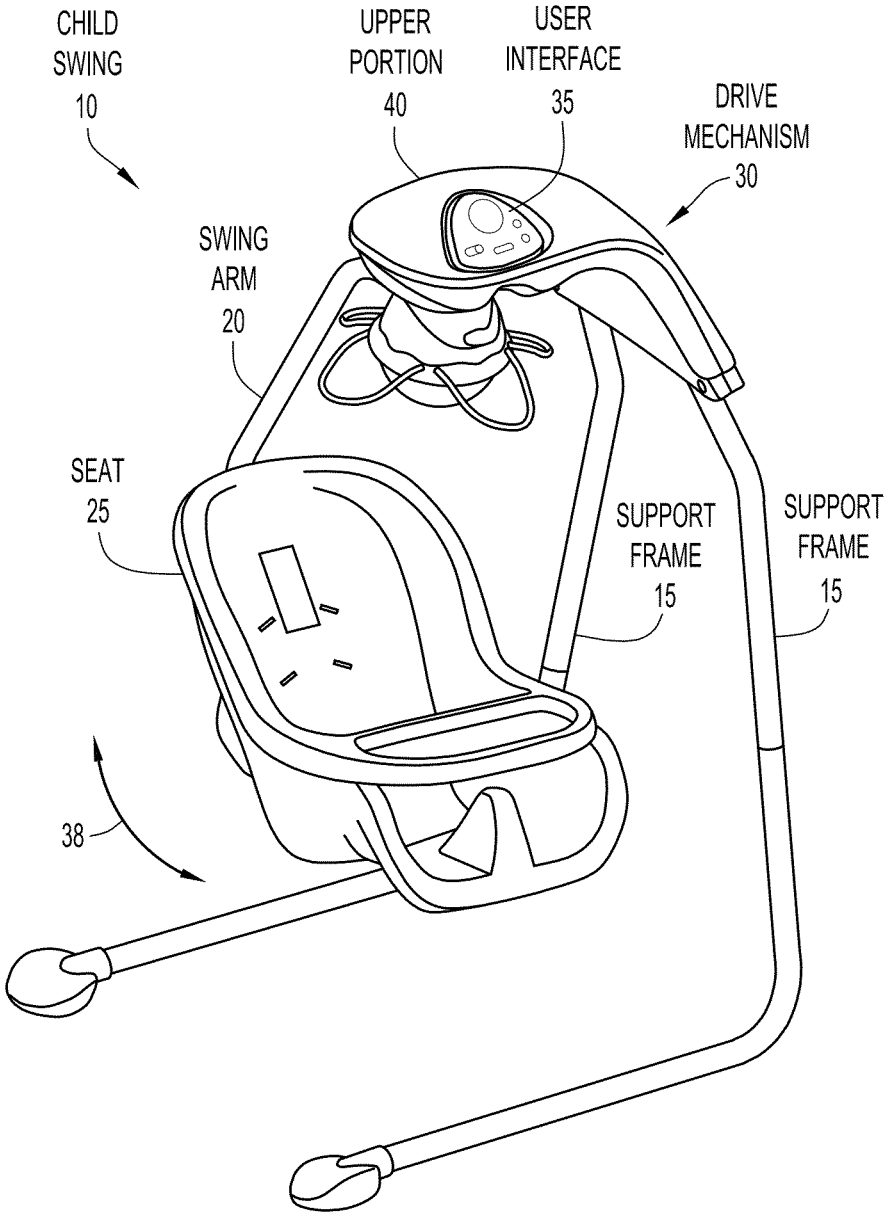
FIG. 1 illustrates a front perspective view of a child swing in accordance with embodiments of the present invention.

Child swings are generally manufactured such that for a selected swing angle, the electric motor will receive a pulse width modulation (PWM) drive signal having a duty cycle that results in a fixed output torque for delivery to the swing arm. However, a child swing operates on the principles of harmonic motion and, as such, the torque required from the motor to maintain a selected swing angle depends on the weight and location of a child in the seat, orientation of the seat to the pendulum, variation in frictional factors, etc. As a result, the motor experiences different "loading" conditions during operation (i.e., the burden placed on the motor due to its driving of the swing arm will vary). Under different loading conditions (i.e., different children, angles, etc.), a constant voltage delivered to the motor may cause an inconsistent motion profile.

In an attempt to produce a consistent motion profile under different loading conditions, child swings have been developed to include feedback systems that correlate desired swing angle to an actual swing angle. Conventional feedback systems generally detect the current height and/or speed of the swing seat (or swing arm) and compare it to the height and/or speed of the swing seat selected by a user. Conventional control systems then use the comparison of the actual height/speed with the desired height/speed to adjust the power provided to the motor and thus adjust the torque exerted on the swing arm.

Described herein is a control system for a child swing that does not rely upon detection of the current height and/or speed of the swing or swing arm for comparison to a desired height and/or speed. Rather, as described further below, control systems in accordance with embodiments of the present invention detect electromotive force (EMF) changes at the swing motor in response to varying load conditions and use the detected EMF changes to adjust the speed of the swing motor. More specifically, the detected changes in EMF at the motor are used adjust the power delivered to the motor such that the motor speeds up or slows down in response to changes in loading conditions.

It is to be understood that EMF-based control systems in accordance with embodiments of the present invention may be used in a wide variety of toys or other applications that include a motor that experiences varying loading conditions. For example, embodiments may be used in child swings or a vehicle launcher system that includes a rotating drive apparatus where a small vehicle is rolled/pushed/sent into the mechanism and ejected out with a force imparted from a motor. Alternatively, embodiments may be used in a ball pitching/kicking/launching system that includes one or more rotating wheels that are used to accelerate and launch a ball that is passed through a spinning mechanism. Additionally, as described further below, embodiments may be used in a remote controlled (RC) car or a robotic toy. Merely for ease of illustration, embodiments will be primarily described with reference to an EMF-based control system for a child swing. It is to be appreciated the specific description of the invention with reference to a child swing is non-limiting.

It is also to be understood that terms such as "left," "right," "top," "bottom," "front," "rear," "side," "height," "length," "width," "upper," "lower," "interior," "exterior," "inner," "outer," "forward," "rearward," "upwards," "downwards," and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

FIG. 1 is a perspective view of one exemplary child swing 10 that may include an EMF-based control system in accordance with embodiments of the present invention. In the illustrative arrangement of FIG. 1, child swing 10 comprises a support frame 15, a swing arm 20, and a seat 25. A drive mechanism 30 and a user interface 35 are disposed in an upper portion 40 of the support frame 15. In operation, the support frame 15 provides a stable base that allows the seat 25 to follow an arcuate path generally shown in FIG. 1 by arrow 38.

Figure 2:
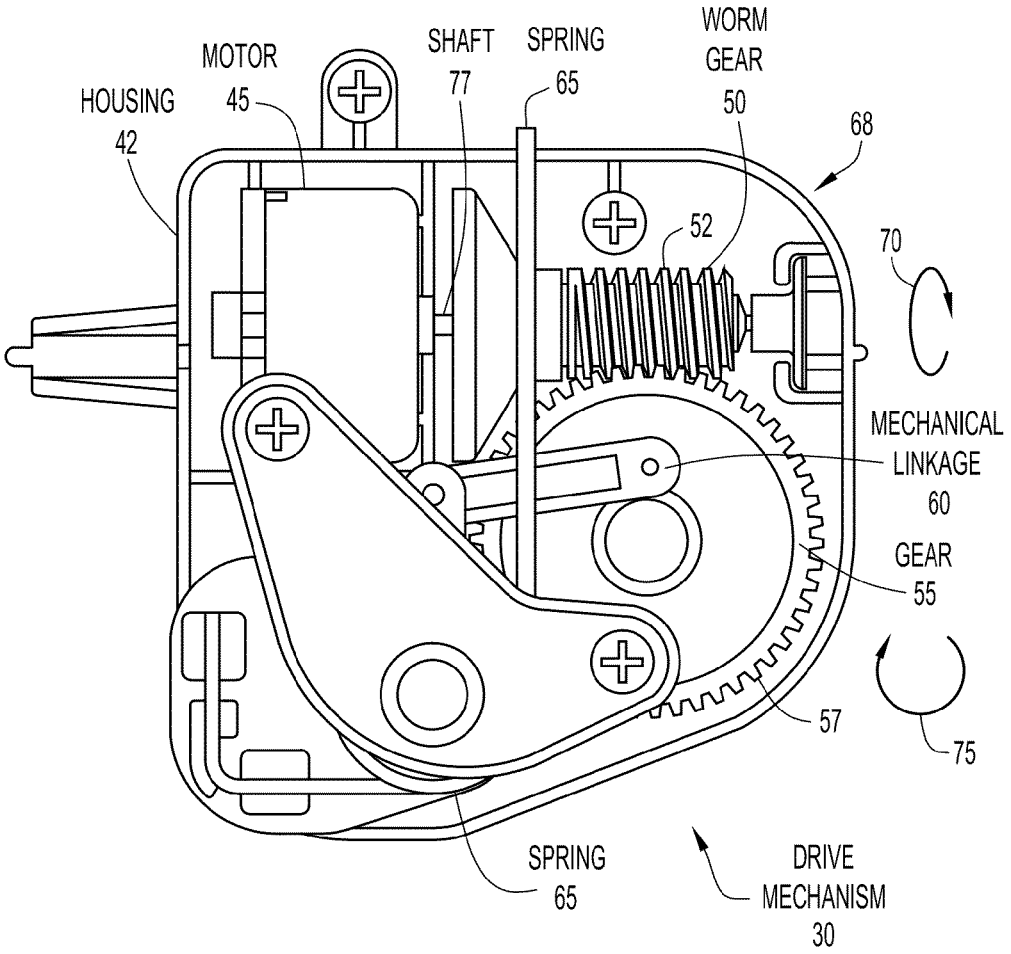
FIG. 2 illustrates a side view of a portion of one example drive mechanism for the child swing of FIG. 1.
Figure 3:
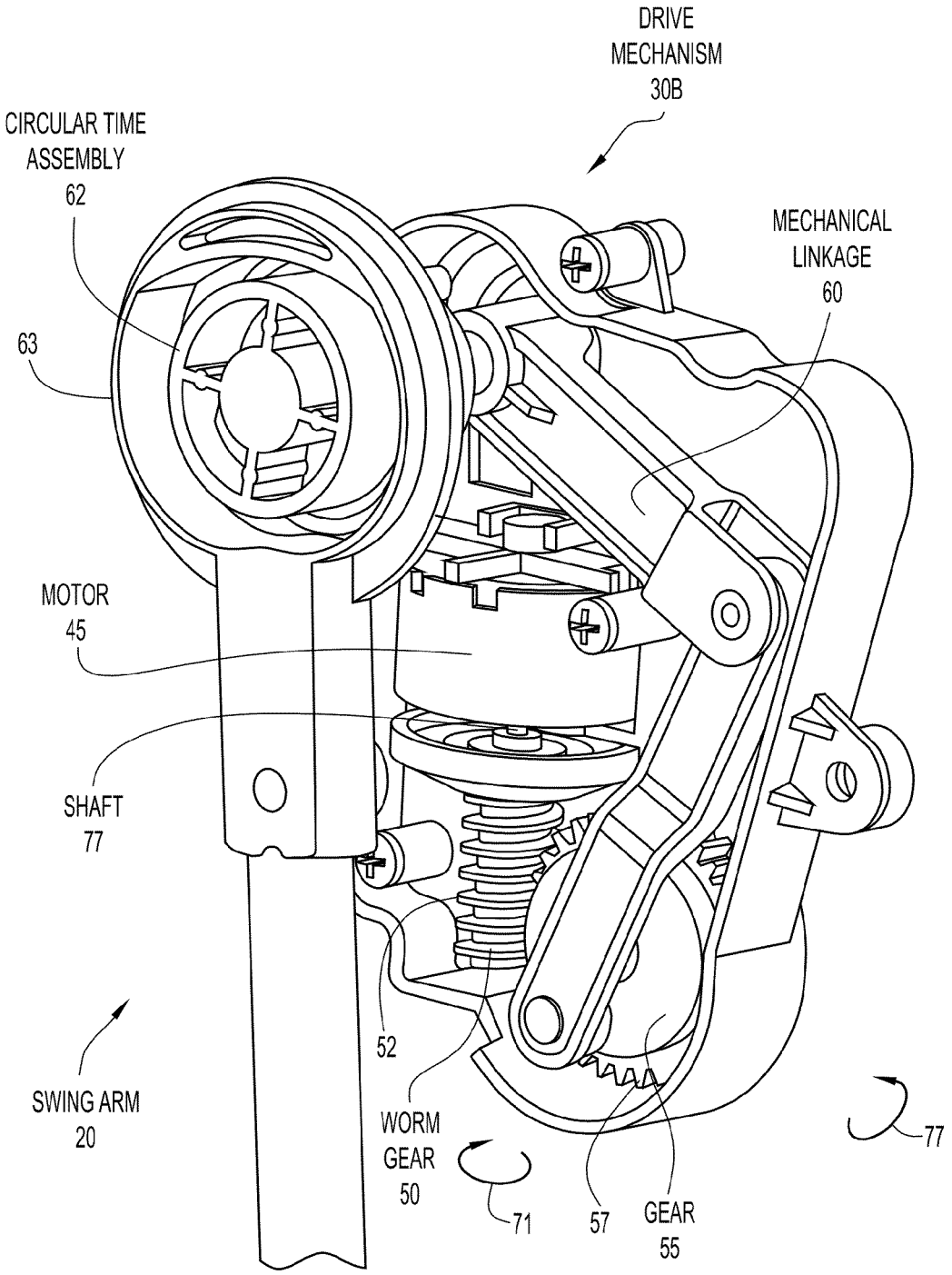
FIG. 3 illustrates a perspective view of a portion of another example drive mechanism for the child swing of FIG. 1.

In motor driven swings, an electric motor is mechanically coupled to a swing arm such that a torque output by the motor causes a swinging motion of the swing arm. Various mechanisms may be used to mechanically couple the swing arm to the motor. For example, certain swings include a so-called "spring drive" mechanism in which a gearbox (attached to the motor) is coupled to the swing arm via a spring. Other swings may use a so-called "friction drive" mechanism where the gearbox is coupled to the swing arm via a circular tire assembly or a "direct drive" mechanism. FIG. 2 illustrates a spring drive mechanism 30A that couples a motor to the swing arm 20. FIG. 3 illustrates a friction drive mechanism 30B that couples a motor to the swing arm 20.

More specifically, FIG. 2 is a side view of a portion of the spring drive mechanism 30A that may be disposed in upper portion 40 (FIG. 1) of child swing 10 (FIG. 1). The illustrated portion of spring drive mechanism 30A includes, among other elements, a worm gear 50, a mating gear 55, a mechanical linkage 60, and a spring bar (spring) 65. A direct current (DC) motor 45 is mechanically coupled to the worm gear 50 via a motor shaft (axle) 77. The motor 45 is electrically connected to a motor drive (not shown in FIG. 2) and a controller (also not shown in FIG. 2) that processes user inputs received via user interface 35 (FIG. 1). User interface 35 allows a user (e.g., parent, caregiver, etc.) to select one of a plurality of swing seat speed and/or height settings. For ease of illustration, swing seat speed or height settings are collectively and generally referred to as "swing angle settings." In response to a swing angle setting, the controller causes the motor drive to provide the motor 45 with a predetermined voltage input. This voltage input causes the shaft 77 of motor 45 to rotate at a predetermined speed and, accordingly, causes worm gear 50 to correspondingly rotate. The speed at which shaft 77 rotates is referred to herein as the speed of motor 45. The general direction of rotation of worm gear 50 is shown by arrow 70.

Worm gear 50 includes a series of teeth 52 that mesh with teeth 57 of mating gear 55. As such, rotation of worm gear 50 in the direction of arrow 70 results in corresponding rotation of mating gear 55 in the direction shown by arrow 75. The rotation of mating gear 55 causes reciprocal motion of mechanical linkage 60 so as to tension spring 65. Spring 65 is coupled to swing arm 20 such that spring-action (tension) of the spring 65 cause corresponding motion of the swing arm 20. The mechanical components connecting the motor 45 to the swing arm 20 (i.e., worm gear 50, mating gear 55, mechanical linkage 60, and spring 65) are collectively referred to as spring drive mechanism 30A.

FIG. 3 is a side view of a portion of the friction drive mechanism 30B that may be disposed in upper portion 40 (FIG. 1) of child swing 10 (FIG. 1). Similar to the embodiments of FIG. 2, friction drive mechanism 30B includes, among other elements, a worm gear 50, a mating gear 55, and a mechanical linkage 60. However, instead of a spring 65 (FIG. 2), the friction drive mechanism 30B includes a circular tire assembly 62.

Similar to the above arrangement, in FIG. 3 motor 45 is mechanically coupled to the worm gear 50 via shaft 77 and is electrically connected to a motor drive (not shown in FIG. 3) and a controller (also not shown in FIG. 3) that processes user inputs received via user interface 35 (FIG. 1). In response to a swing angle setting selected at user interface 35, the controller causes the motor drive to provide the motor 45 with a predetermined voltage input. This voltage input causes the shaft 77 of motor 45 to rotate at a predetermined speed and, accordingly, causes worm gear 50 to correspondingly rotate. The general direction of rotation of worm gear 50 is shown by arrow 71.

Worm gear 50 includes a series of teeth 52 that mesh with teeth 57 of mating gear 55. As such, rotation of worm gear 50 in the direction of arrow 71 results in corresponding rotation of mating gear 55 in the direction shown by arrow 79. The rotation of mating gear 55 causes reciprocal motion of mechanical linkage 60 so as to cause reciprocal motion of circular tire assembly 62. In this example, the swing arm 20 includes a circular member 63 that is friction-fit around the outer surface of the circular tire assembly 62. Due to the friction-fit of circular member 63 around circular tire assembly 62, the reciprocal motion of the circular tire assembly 62 can be transferred to the swing arm 20. The mechanical components connecting the motor 45 to the swing arm 20 (i.e., worm gear 50, mating gear 55, mechanical linkage 60, and circular tire assembly 62) are collectively referred to as friction drive mechanism 30B.

Figure 4A:
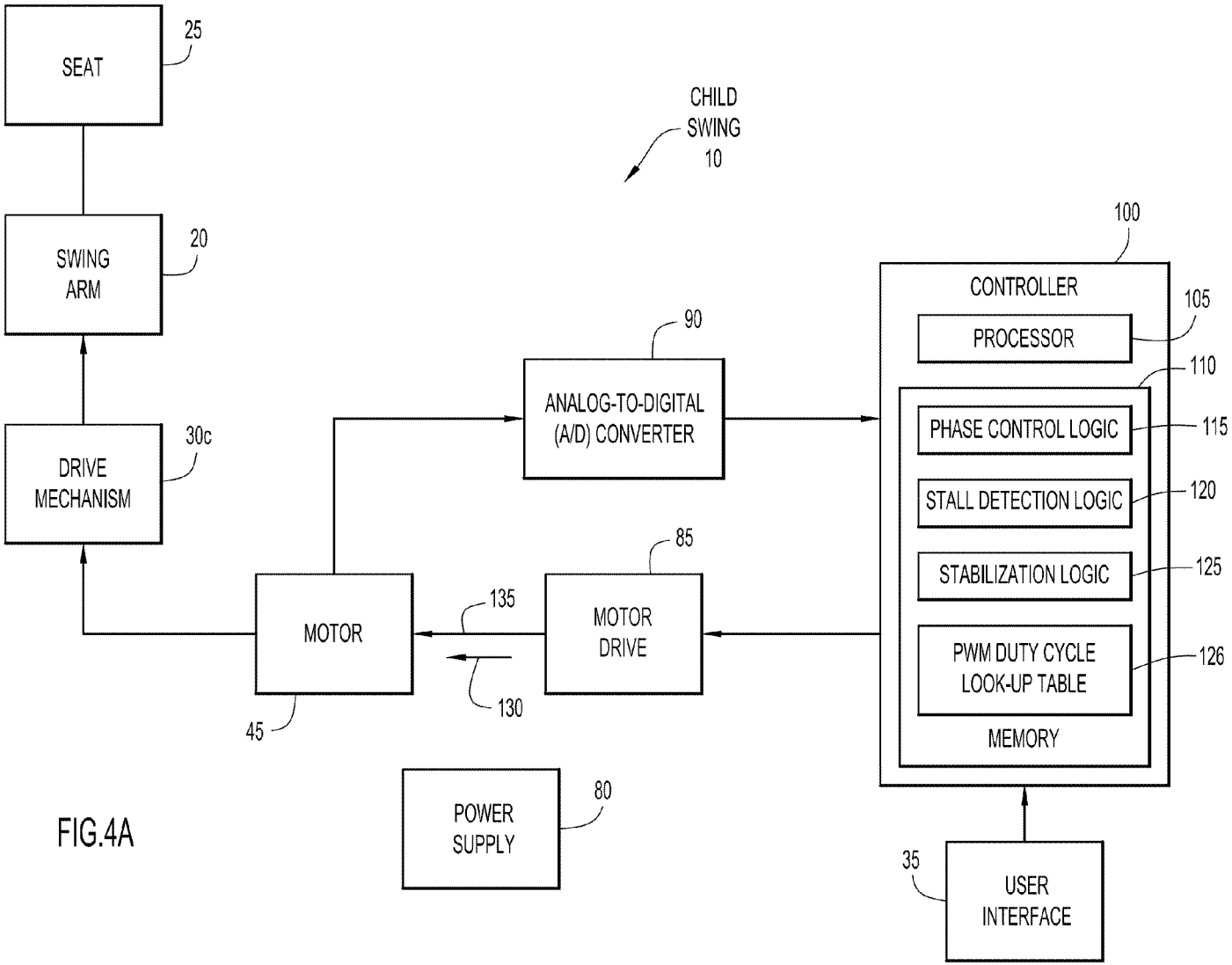
FIG. 4A is a system block diagram of the child swing of FIG. 1 comprising an EMF-based control system in accordance embodiments of the present invention.

FIG. 4A is a functional block diagram of an embodiment of child swing 10 (FIG. 1) that includes swing arm 20 attached to seat 25, drive mechanism 30C, motor 45, and a user interface 35. Drive mechanism 30C may be a spring drive mechanism 30A (FIG. 2), a friction drive mechanism 30B (FIG. 3), a direct drive mechanism, or any other swing drive mechanism now known or later developed. The child swing 10 also comprises a power supply 80, a motor drive 85, an analog-to-digital (A/D) converter 90, and a controller 100.

The controller 100 comprises a processor 105 and a memory 110. Memory 110 comprises, among other elements, phase control logic 115, stall detection logic 120, stabilization logic 125, and a PWM duty cycle look-up table 126. The memory 110 may comprise read only memory (ROM), random access memory (RAM), magnetic disk storage media devices, optical storage media devices, flash memory devices, electrical, optical, or other physical/tangible memory storage devices. The processor 105 is, for example, a microprocessor or microcontroller that executes instructions for the phase control logic 115, stall detection logic 120, and stabilization logic 125. Thus, in general, the memory 110 may comprise one or more tangible (non-transitory) computer readable storage media (e.g., a memory device) encoded with software comprising computer executable instructions and when the software is executed (by the processor 105) it is operable to perform the operations described herein in connection with the phase control function (through execution of phase control logic 115), the stall detection function (through execution of stall detection logic 120), and stabilization function (through execution of stabilization logic 125).

More specifically, the control system of FIG. 4A is a software/controller based implementation where various software modules (phase control logic 115, stall detection logic 120, and stabilization logic 125) are executable by processor 105 to perform the operations described below with reference to the phase control, stall detection, and stabilization functions. It is to be appreciated that the arrangement shown in FIG. 4A is merely illustrative and child swing 10 may include other combinations of hardware/software components.

In operation, a user selects a swing angle setting at user interface 35 and controller 100 instructs motor drive 85 to supply a drive signal 130 to motor 45 via an input signal line 135. The drive signal 130 is a pulse width modulation (PWM) signal that regulates the speed of the motor 45 (i.e., how fast the shaft 77 of the motor rotates). As noted above, the rotation of shaft 77 imparts, via drive mechanism 30C, a force on the swing arm 20.

Changes in the PMW duty cycle of the drive signal 130 are used to change the speed of the motor 45 and consequently the swing angle of the swing 20. For example, a selection of a speed "1" at user interface 35 could set the PWM duty cycle of drive signal 130 to 15%, and this might translate to a 12 degree swing angle (as a result of the transfer of force to the swing arm 20 from the motor 45 via drive mechanism 30C). Alternatively, a selection of a speed "5" at user interface 35 could set the PMW duty cycle of drive signal 130 to 60%, and this might translate to a 55 degree swing angle.

In the embodiments described herein, swing arm 20 is considered to have two "phases" of operation during a swing period. The first phase of swing arm 20 occurs when the swing arm 20 moves in a first direction (e.g., forward), while the second phase of swing arm 20 occurs when the swing arm 20 moves in the second, opposite direction (i.e., backward). For example, during the first phase the swing arm 20 swings in a direction to push seat 25 forward. When seat 25 reaches the forward apex, the swing arm 20 reverses to the second phase and, in this example, moves in a direction so that the seat 25 is forced (or freely moves) rearward. The phase of swing arm 20 will again reverse when the seat 25 reaches a rear apex. In other words, swing arm 20 has a reciprocating motion and reverses phase at each apex of seat 25.

In response to rotation of shaft 77 of motor 45, drive mechanism 30C is configured to excerpt force on the swing arm 20. In general, drive mechanism 30C (whether it has a spring-drive arrangement or a friction-drive arrangement) undergoes reciprocating motion such that it only applies a force to the swing arm 20 during part of a drive cycle. Accordingly, drive mechanism 30C is referred to as having two phases of operation, namely a first phase in which it applies force to swing arm 20 and a second phase in which no force is applied to swing arm 20.

In order to ensure that the swing arm 20 smoothly follows the desired arcuate path (i.e., has a consistent motion profile), the movement of the swing arm 20 and the reciprocation of the drive mechanism 30C should remain "in-phase." In other words, the phases of swing arm 20 and drive mechanism 30C should maintain a desired alignment so that the drive mechanism 30C applies a force to the swing arm 20 at appropriate times. If the drive mechanism 30C were perfectly in phase with the swing arm 20, then the drive mechanism 30C would not be able to add energy to the system and the swing arm 20 would not swing. For example, with a fixed lead angle of 0 degrees (i.e., the motor linkage and swing arm reversing direction simultaneously), no energy is added to the child swing and the swing arm will not move or, if already in motion, will eventually stop. As such, in order to add energy to the system, the phase of the drive mechanism 30C is "advanced" relative to the phase of the swing arm 20. This "advance" means that the phase of the drive mechanism 30C needs to "lead" the phase of the swing arm 20.

As used herein, the drive mechanism 30C and swing arm 20 are considered to be "in-phase" when the phase of the drive mechanism 30C appropriately leads the phase of the swing arm 20. Therefore, when "in-phase" the drive mechanism 30C and swing arm 20 will rotate/reciprocate at the same speed and their phase transitions (180 degree points) will be aligned (subject to the advance of the drive mechanism 30C).

As noted above, the actual swing angle in response to an input voltage to motor 45 may vary depending on, for example, different loading conditions (e.g., different sized children, location of a child in the seat, friction, etc.). In order to produce a consistent motion profile under different loading conditions, child swing 10 includes an EMF-based control system that, among other uses, is configured to perform a phase control function (i.e., for keeping the swing arm 20 in phase (aligned with) with the drive mechanism 30C used to propel the swing). Additionally or alternatively, the EMF-based control system is configured to perform a swing stall detection function (i.e., to detect an error condition with the swing arm). The phase control aspects are important to enable efficient energy transfer from the motor to the swing arm. The swing stall detection aspects provide a way for the hardware/ software controlling the motor 45 to determine if the swing arm 20 is actually swinging at the desired angle or has been disturbed/stopped and is no longer properly functioning. A unique aspect of this digital swing drive control system is that it does not utilize any external sensors on the swing arm or drive system to perform measurements of swing height or speed. Rather, the control system operates using EMF generated by the motor 45. In the embodiments of FIG. 4A, the control system is implemented as controller 100.

During a typical swing cycle (also known as a swing period), the motor 45 will heavily load on the swing's upswing, substantially unload during the down swing as the swing falls, load again as the swing rises and unload again as the swing falls again completing the cycle. As noted, the load of motor 45 refers to the burden placed on the motor 45 as it operates (i.e., the motor 45 is placed under a heavier burden when exerting a force to push the swing arm 20 upwards, and a less or minimal burden when the motor 45 is not exerting a force on the swing arm 20).

As the motor 45 loads to exert a force on the swing arm 20, energy is removed and the speed of the motor 45 drops (i.e., the motor slows down). As the motor 45 unloads and begins to coast, or "free wheel," during the falling part of the swing period, no energy is transferred from the motor 45 to the drive mechanism 30C and the speed of the motor 45 increases (i.e., the motor 45 speeds up). This variation in motor speed reduces the ability to efficiently transfer energy to the drive mechanism 30C (when needed) and results in the drive mechanism 30C running "out of phase" with the swing arm 20. This issue is overcome in the new swing control system by monitoring the EMF (in this case voltage) generated by the motor 45 during the off period between PWM pulses of drive signal 130.

More specifically, as the motor 45 loads (during the upswing of swing arm 20) the EMF voltage generated by the motor 45 drops as the motor speed decreases. The A/D converter 90 samples the input signal line 135 so that the controller 100 can detect this drop in EMF. The controller 100 responds by proportionally increasing the duty cycle of drive signal 130 in the next PWM drive pulse. This increase in power to the motor 45 offsets the added load of driving the swing arm 20 upwards and allows the motor 45 to stay at a substantially constant speed. Conversely, as the motor unloads during the downward portion of the swing period, the EMF generated by the motor 45 rises. The A/D converter 90 again samples the input signal line 135 so that the controller 100 can detect this rise in EMF. The controller 100 proportionally decreases the duty cycle of drive signal 130 in the next PWM drive pulse. This decrease in power to the motor 45 prevents the motor from speeding up as the swing falls. Keeping the motor at a substantially constant speed, despite the varying load conditions of the swing cycle, allows the drive mechanism 30C to remain substantially in phase with the swing arm 20.

As noted, the phase control functions use an A/D converter to sample the EMF at input signal line 135. The A/D converter 90 and controller 100 work together as follows during a typical PWM period. First, the controller 100 generates a positive PWM drive pulse. At the end of the PWM drive period, the controller 100 turns off the positive drive pulse. This results in a back-EMF spike (the voltage at the motor 45 quickly switches to ground) that is detected by the controller 100 via sampling of the input signal line 135 by A/D converter 90. After detection of the back-EMF spike, the controller 100 uses the A/D converter 90 to sample the EMF at fixed intervals. The controller 100 then uses a plurality of EMF samples to calculate an average EMF value. This average EMF value is used to determine if the load to the motor is increasing, decreasing, or remaining constant. The controller 100 then uses this information to adjust the duty cycle of the next PWM drive pulse and the cycle begins again. Further details of the phase control functions in accordance with embodiments of the present invention are provided below with reference to FIGS. 5 and 6.

While a swing is in operation, it is possible that an outside event (i.e., a parent stops the swing to adjust the child, a pet runs by and bumps the swing, the baby shifts his head, legs or arms, etc.), the weight distribution, etc. can disturb the rhythmic swing period. The phase control function described elsewhere herein is configured to account for and resolve small disturbances. However, in certain circumstances the disruption in the swing period may be sufficiently large that the phase control function cannot correct the swing. In such cases, the swing should be placed in a stabilization or startup routine that, in essence, re-starts the swing operation in a controlled manner. The EMF-based control system in accordance with embodiments of the present invention is also configured to detect the effects of such disturbance and cause the swing to enter the stabilization routine. Such operation is referred to herein as the stall detection functions of the EMF-based control system.

In certain embodiments, the stall detection functions of the EMF-based control system may be implemented at substantially the same time as the phase control functions and make use of the phase control information. For example, the phase control functions result in the calculation and storing (e.g., in memory) of average EMF values for PWM periods for a number (n) of complete swing cycles. In the stall detection functions, the controller 100 uses a plurality of these average EMF values to generate a "long-term" average EMF value. The number of swing cycles that are used depends on the level of hysteresis desired by the system. For example, a system with tight tolerances may utilize only 1-2 swing periods to calculate the long-term average EMF value, while a system with lower tolerances may utilize 3 or more swing cycle to calculate the long-term average EMF value.

During the stall detection functions, the long-term EMF average is compared to an upper EMF limit (upper stall limit) and a lower EMF limit (lower stall limit) to determine if the long-term EMF remains within an acceptable operating window. For example, the swing 10 may be functioning properly at speed "1" and a parent briefly stops the swing by simply grabbing the seat to check on the child, then releases the swing and walks away. The normal PWM duty cycle required to maintain speed "1" may not put enough energy into the motor to restart the swing. If this happens, when the motor loads, the increase in PWM duty cycle in response to the load (as above), will not be enough to maintain the desired constant motor speed. As a result, overall, the EMF averages will start to become lower than expected. This will result in the long-term average EMF value falling below the established lower limit. In one embodiment, when the controller 100 detects this failure (a swing stall condition) it may temporarily increase the PWM duty cycle until the long-term average EMF value returns to a stable value and falls inside the upper and lower limits. In an alternative embodiment, instead of the increasing the PWM duty cycle of drive signal 130, the controller 100 may cause the control system to enter a stabilization routine.

In an example stabilization routine, the control system does not attempt to fix the stall condition. Rather, the swing is allowed to slow to a point in which the control system 100 can safely drive the swing arm 20 in a controlled manner. In the stabilization routine, the control system 100 may gradually increase the speed of the motor 45 so that swing arm 20 returns to a desired swing angle.

If, for example, the same disturbance as above (i.e., parent briefly stops the swing by simply grabbing the seat to check on the child, then releases the swing and walks away) happens while the swing is set to speed "5," the PWM duty cycle might be so large that it may put too much energy into the motor to restart the swing. If this happens, when the motor loads, the increase in PWM duty cycle in response to the load will put too much energy into the system, and cause the motor to run much faster than the desired constant speed. This will cause the motor to keep running out of phase with the swing arm. As a result, overall, the EMF averages will start to become much larger than expected. This will result in the long-term average EMF value rising above the established upper limit. In one embodiment, when the controller 100 detects this failure (also a swing stall condition) it may temporarily decrease the PWM duty cycle until the long-term average EMF value returns to a stable value and falls inside the upper and lower limits. In an alternative embodiment, instead of decreasing the PWM duty cycle of drive signal 130, the controller 100 may cause the control system to enter a stabilization routine.

Figure 4B:
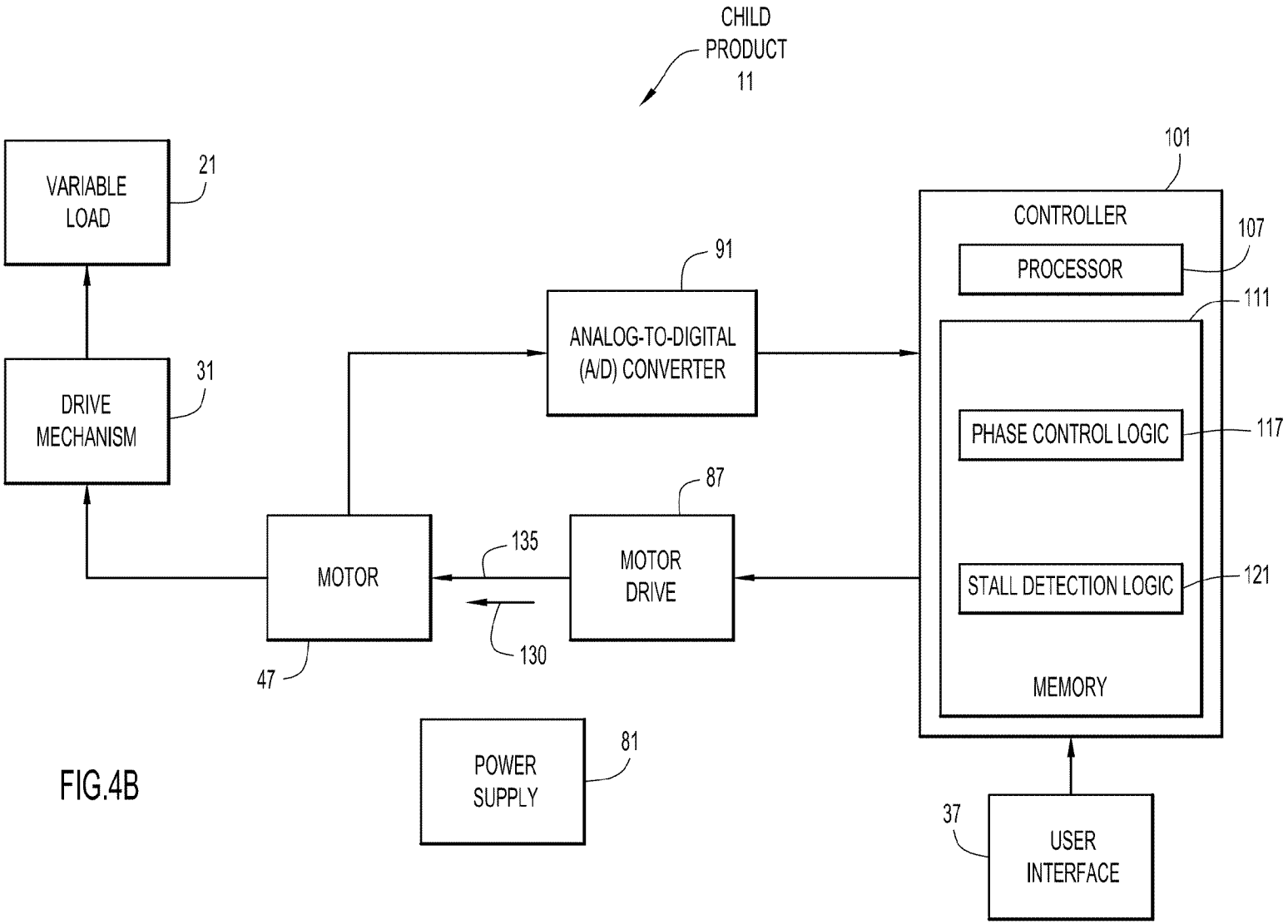
FIG. 4B is a system block diagram of a child product having an EMF-based control system in accordance embodiments of the present invention.

As noted above, an EMF-based control system in accordance with embodiments of the present invention may be used in a wide variety of toys or other applications that include a motor that experiences varying loading conditions. FIG. 4B is a generic functional block diagram of an alternative child product 11 that includes an EMF-based control system in accordance with embodiments of the present invention. The child product 11 may be, for example, a different child swing, vehicle launcher system, ball pitching/kicking/launching system, a remote controlled (RC) car, a robotic toy, etc. Similar to the arrangement of FIG. 4A, the child product 11 comprises a drive mechanism 31, a motor 47, a user interface 37, a power supply 81, a motor drive 87, an A/D converter 91, and a controller 101.

The controller 100 comprises a processor 107 and a memory 111. Memory 111 comprises, among other elements, phase control logic 117 and stall detection logic 121. The memory 111 may comprise ROM, RAM, magnetic disk storage media devices, optical storage media devices, flash memory devices, electrical, optical, or other physical/tangible memory storage devices. The processor 107 is, for example, a microprocessor or microcontroller that executes instructions for the phase control logic 117 and stall detection logic 121. Thus, in general, the memory 111 may comprise one or more tangible (non-transitory) computer readable storage media (e.g., a memory device) encoded with software comprising computer executable instructions and when the software is executed (by the processor 107) it is operable to perform the operations described herein in connection with the phase control function (through execution of phase control logic 117) and the stall detection function (through execution of stall detection logic 121).

More specifically, the control system of FIG. 4B is a software/controller based implementation where various software modules (phase control logic 117 and stall detection logic 121) are executable by processor 107 to perform the operations described below with reference to the phase control and stall detection functions. It is to be appreciated that the arrangement shown in FIG. 4B is merely illustrative a child product 11 may include other combinations of hardware/software components.

In the child product 11, the motor 47 uses the drive mechanism 31 to drive a variable load 21. In operation, controller 101 instructs motor drive 87 to supply a drive signal 130 to motor 47 via an input signal line 135. The drive signal 130 is a PWM signal that regulates the speed of the motor 47 (i.e., how fast the shaft of the motor rotates). The rotation of the motor imparts, via drive mechanism 31, a force on the variable load. Changes in the PMW duty cycle of the drive signal 130 are used to change the speed of the motor 47.

In one example, the child product 11 of FIG. 4B is a vehicle launcher system or ball pitching/kicking/launching system that includes a rotating mechanism (i.e., the variable load) that is driven by the motor 47. In operation, an object (e.g., vehicle, ball or other item) is introduced (e.g., rolled, pushed, sent, etc.) into the rotating mechanism and ejected out with a force imparted from the motor 47. The phase-control aspects of the EMF-based control system (i.e., controller 101) may be used adjust the speed of the motor 47 depending on whether an object is introduced into the rotating mechanism. For example, the speed of the motor 47 may be reduced to save power when a low load is detected (i.e., no object is introduced into the rotating mechanism) and be increased when a load is detected (i.e., as an object is introduced).

Additionally, the child product 11 of FIG. 4B is an RC vehicle or a robotic toy that uses a motor to impart motion to another part (i.e., wheels, arm, leg, head, etc.). In the specific case of an RC vehicle, if the RC vehicle is climbing a hill or descending a hill, the EMF-based control system may be used to increase or decrease the power supplied to the motor 47 to maintain a constant speed. Similarly, other changes in driving conditions (e.g., transition from hardwood floor to carpeting) which cause a change in the motor loading could be compensated for in the same manner to enable a constant speed to be maintained. If the RC vehicle collides with an obstacle and can no longer move, the stall detection functions could be used to prevent wear on the motor and gearbox, thereby preventing unnecessary battery drain.) In the context of a robotic toy, the phase control based on load detection and stall detection on the motor 47 could prevent the need for complex clutch mechanisms in gear boxes if a moving limb(s) were prevented from completing their range of motion as intended It is to be appreciated that the various child products described above with reference to FIG. 4B are used to show the use of the phase control and stall detection functions in different scenarios. It is also to be appreciated that these specific child products are merely illustrative of a number of different products that may use an EMF-based control system in accordance with embodiments of the present invention.

Figure 5:
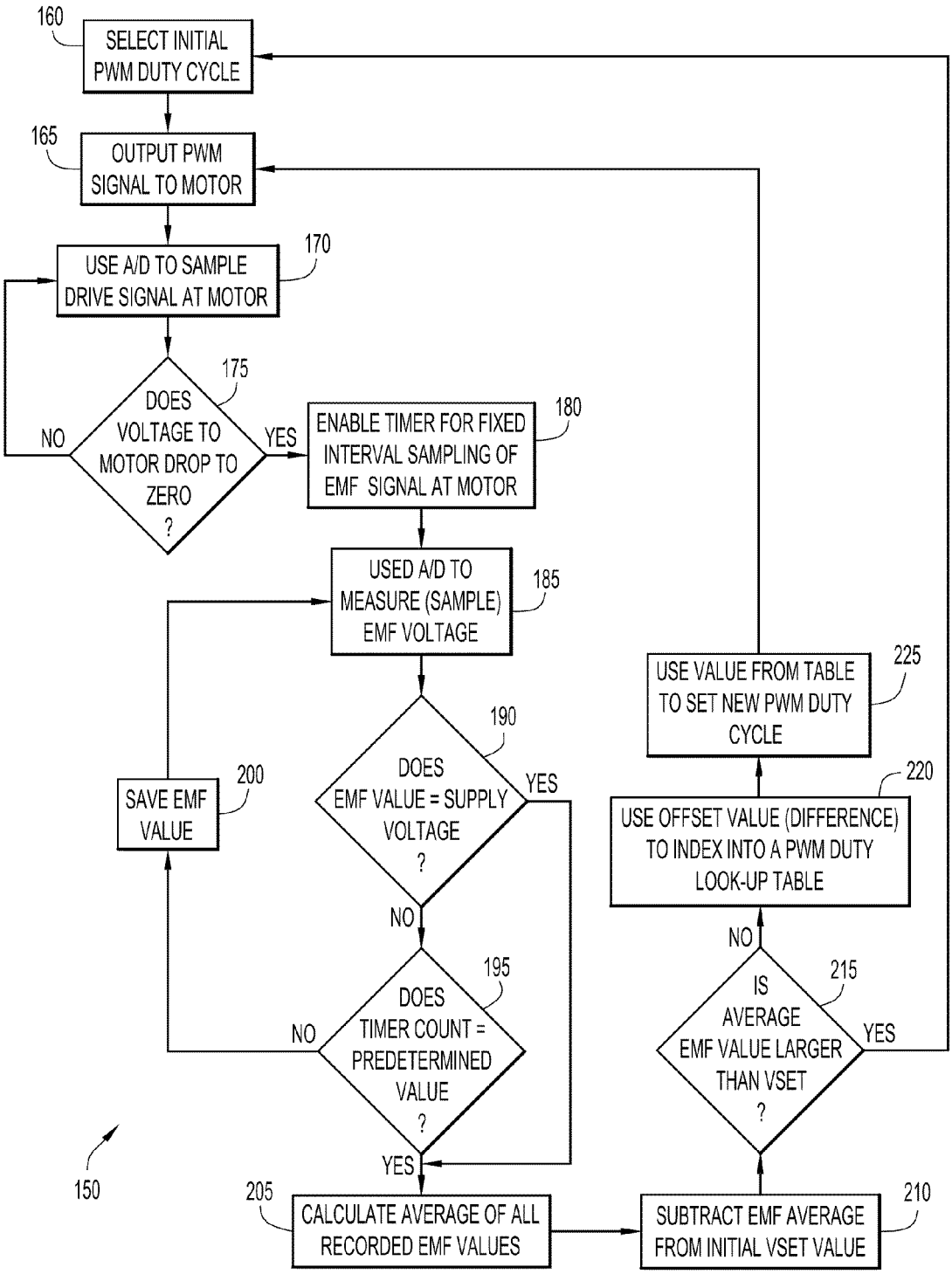
FIG. 5 is a flowchart of a phase control method in accordance with embodiments of the present invention.
Figure 6:
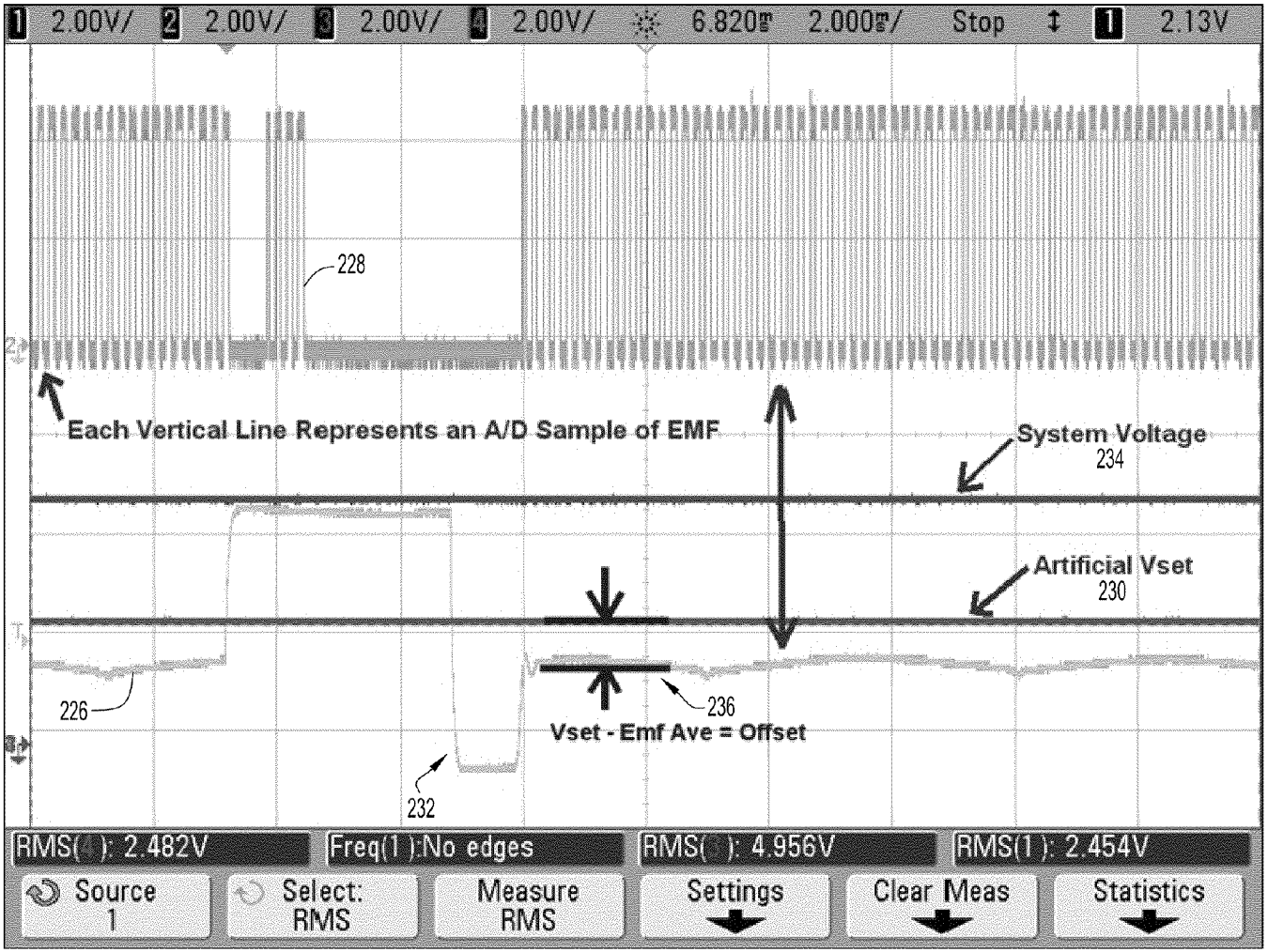
FIG. 6 is an annotated screenshot of an oscilloscope screen during a portion of the method of FIG. 5.

FIG. 5 is a flowchart of an example phase control method 150 for performance of phase control functions in a child swing or other product in accordance with embodiments presented herein. FIG. 6 is a capture of an oscilloscope screen during portions of the method 150 of FIG. 5. FIG. 6 includes a first trace 226 that represents the voltage at input supply line 135 and a second trace 228 that represents sampling of the voltage at input supply line 135 by A/D converter 90. For ease of illustration, the embodiments of FIGS. 5 and 6 will be described with reference to the arrangement of FIG. 4A.

The phase control method 150 of FIG. 5 begins at block 160 where an initial duty cycle of the PWM drive signal 130 is selected. The initial duty cycle corresponds to a reference value referred to herein as Vset. As noted, the drive signal 130 has a variable duty cycle that is used to control the speed of the motor 45. The reference value (Vset) is represented in FIG. 6 by trace 230.

At 165, the drive signal 130 is output to motor 45. At block 170, the A/D converter 90 is used to sample, at the input signal line 135, the voltage signals being sent to the motor 45 (i.e., the voltage levels of the drive signal 130) as well as the voltage generated by the motor 45 (i.e., EMF generated by the motor 45 between pulses of the drive signal 130). The A/D converter 90 is also configured to provide the samples of the input signal line 135 to controller 100.

At block 175, a determination is made as to whether the voltage at the input signal line 135 has fallen to zero. If the voltage at the input signal line 135 is not zero, then method 150 returns to block 170 for continued sampling of the input signal line. If it is determined that the voltage at the input signal line 135 is zero, then the method 150 progresses to block 180.

In essence, at block 175, the controller 100 uses samples provided by the A/D converter 90 to determine when the voltage to motor 45 drops to zero. A determination that the voltage at the input signal line has dropped to zero means that a pulse of the drive signal 130 has just ended (i.e., back-EMF spike). Reference 232 in FIG. 6 illustrates the point at which the voltage at the input signal line 135 drops to zero.

At block 180, a timer is enabled so that the input signal 135 is sampled at fixed intervals for a certain number of times, for a certain time period, until start of the next PWM positive drive pulse, etc. At 185, the A/D converter 90 is used to measure the EMF value (voltage) at the input signal line 135 at a first one of the fixed intervals. At 190, a determination is made as to whether the measured EMF value is equal to the supply voltage (i.e., the voltage of a drive pulse), shown in FIG. 6 by trace 234. If the measured EMF is equal to the supply voltage, then it is determined that the next drive pulse has started and, accordingly, the method progresses to block 205 where the EMF sampling is stopped for a period of time. However, if it is determined at block 190 that the EMF is not equal to the supply voltage, then a determination is made at 195 as to whether the timer count equals a predetermined value. In the example of FIG. 5, this predetermined value is 128. If the timer count does not equal the predetermined value, then at block 200 the measured EMF is saved (e.g., in memory 110 of controller 100) and the method returns to block 185 for another sample. However, if the timer count does equal the predetermined value, then it is determined that the system has recorded a sufficient number of EMF values and the method progresses to block 205.

At block 205, an average of the EMF values measured in the current sampling window (i.e., subsequent to the termination of the last drive pulse) is calculated. In other words, the control system determines the average EMF value on the input signal line 135 after the last drive pulse. This average EMF value is used to select a new duty cycle for the drive signal 130. Blocks 210 through 225 illustrate one exemplary method for using the average EMF value to calculate the new duty cycle for the drive signal 130.

More specifically, at block 210, the average EMF value corresponding to the last drive pulse is subtracted from the initial Vset to generate an offset value. The offset value (i.e., difference between Vset and the average EMF value) is shown in FIG. 6 by reference 236. At 215, a determination is made as to whether the average EMF value is larger than the Vset. In general, if the average EMF value is larger than the Vset, the method returns to 160. However, if the average EMF value is consistently larger than the Vset consistently, the system may determine that a stall condition has or is likely to occur.

Returning to block 215, if the average EMF value is smaller than the Vset, at block 220 the offset value is used as an index into a PWM duty cycle look-up table 126. In certain embodiments, the PWM duty cycle look-up table 126 represents a uniform system gain of one. As the offset value grows, the PWM value grows and as the offset value decreases, the PWM value decreases. At 225, the corresponding value from the PWM duty cycle look-up table 126 is used to set the new duty cycle of the drive signal 130 and the method returns to block 165.

In summary, the phase control functions are implemented such that the control system (e.g., controller 100) can monitor the EMF generated by the motor 45 at the input signal line 135. The control system is then configured to use the monitored EMF to control the speed of the motor 45. More specifically, the motor 45 initially operates at a predetermined speed and experiences variable loading conditions as a result of the mechanical coupling to the swing arm 20. The control system is configured to use the monitored EMF to detect changes in loading conditions experienced by the motor 45 and to adjust the speed of the motor in response to the changes in loading conditions such that the drive mechanism remains substantially in-phase with the swing arm such that phase changes of the drive mechanism lead phase changes. The control system may be configured to control the speed of the motor 45 by adjusting the duty cycle of the drive signal 130 in response to the monitored EMF.

Figure 7:
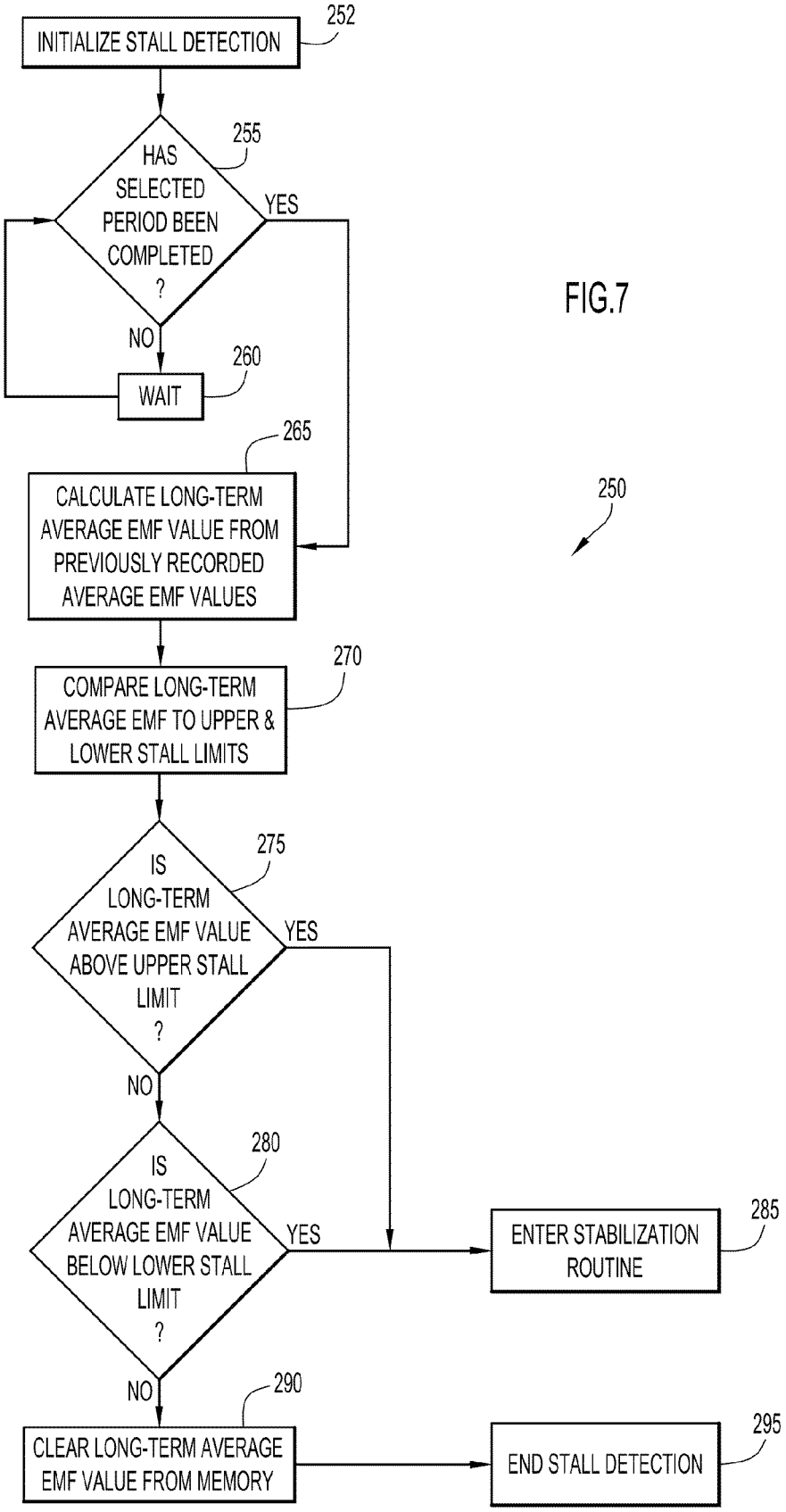
FIG. 7 is a flowchart of a stall detection method in accordance with embodiments of the present invention.
Figure 8:
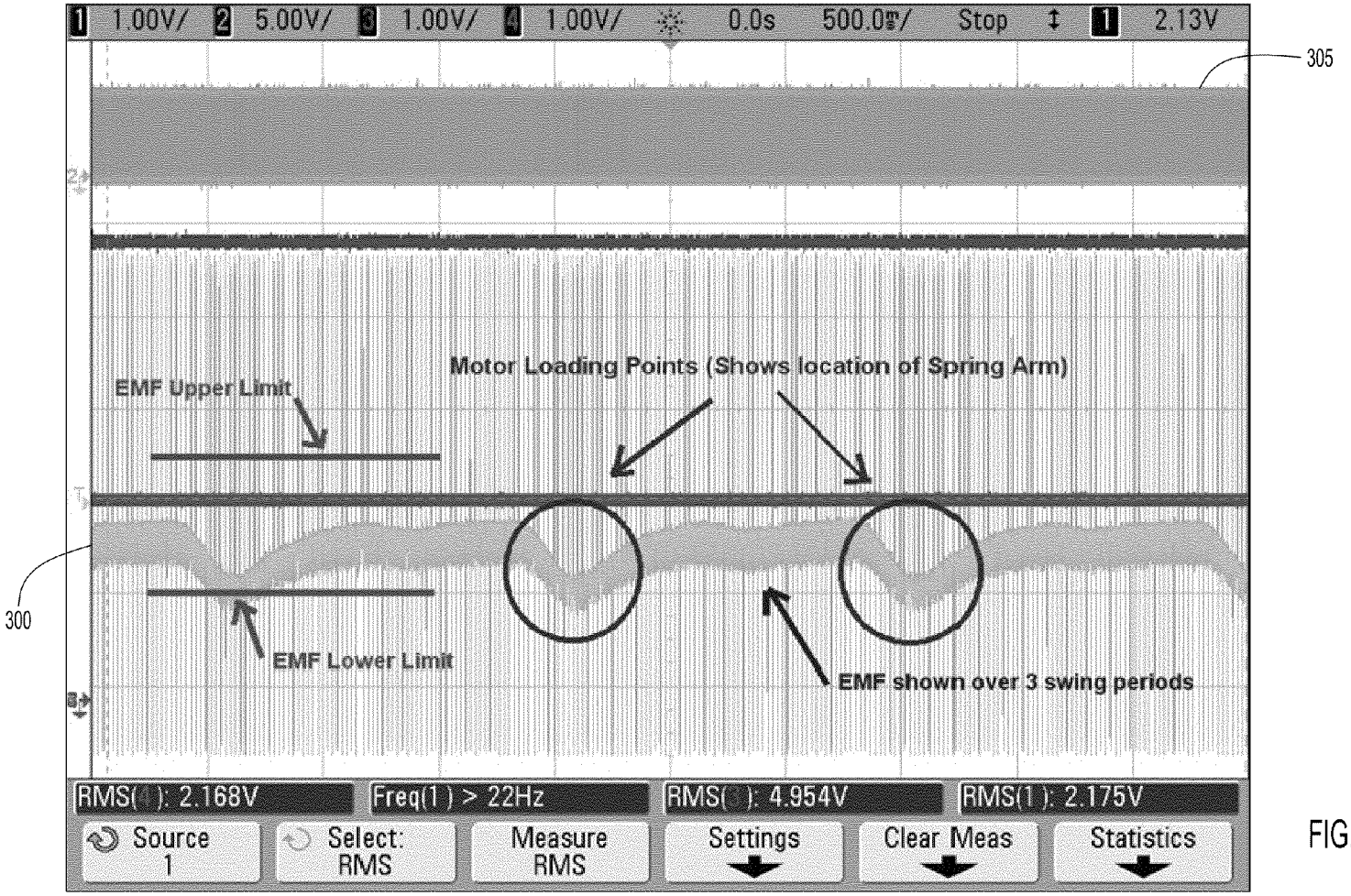
FIG. 8 is an annotated screenshot of an oscilloscope screen during a portion of the method of FIG. 7.

FIG. 7 is a flowchart of an example stall detection method (stall detection functions) in accordance with embodiments presented herein. FIG. 8 is a screen capture of an oscilloscope screen during portions of the method of FIG. 7. FIG. 8 includes a trace 300 that represents the EMF detected at input supply line 135 over several swing periods. For ease of illustration, the embodiments of FIGS. 7 and 8 will be described with reference to the arrangement of FIG. 4A.

Method 250 of FIG. 7 begins at block 252 wherein the stall detection routine is initiated (e.g., by controller 100). At 255, a determination is made as to whether a selected period has been completed. This determined may be, for example, a determination as to whether a number (n) of EMF values have been recorded, a determination of whether a predetermined number (n) of swing periods have been completed, etc. If the selected period has been completed, method 250 progresses to block 265. However if the selected period has not been completed, then at 260 the method waits for a period of time before returning to block 255.

At block 265, a plurality of previously recorded average EMF values (e.g., average EMF values calculated within a given time period, a predetermined number of average EMF values, etc.) are averaged to generate a "long-term" average EMF value. More specifically, in certain embodiments the control system stores the EMF average that is calculated for each PWM pulse (described in the previous section) for n number of complete swing periods. The controller 100 then uses the sum of all these average calculations to generate the long-term average EMF value. The number of swing cycles that are used depends on the level of hysteresis desired by the system. A system with tight tolerances may utilize only 1-2 swing periods, but, a system with lower tolerances may utilize 3 or more swing cycles.

At block 270, the long-term average EMF value is compared to a predetermined upper EMF limit (upper stall limit) and a predetermined lower EMF limit (lower stall limit). At block 275, a determination is made as to whether the long-term average EMF value is above the predetermined upper limit. If the long-term average EMF value is above the upper limit, then method 250 proceeds to block 285 where the phase control functions (as described above with reference to FIG. 5) are interrupted (stopped) and the swing enters into a stabilization or start-up routine as described elsewhere herein. If the long-term average EMF value is not above the upper limit, method 150 proceeds to block 280. In essence, a determination that the average EMF value is not above the upper limit means that the speed of the motor does not exceed an upper speed limit.

At block 280, a determination is made as to whether the long-term average EMF value is below the predetermined lower limit. If the long-term average EMF value is below the lower limit, then method 250 proceeds to block 285 where the phase control functions (as described above with reference to FIG. 5) is interrupted (stopped) and the swing enters into a stabilization routine as described elsewhere herein. If the long-term average EMF value is not below the upper limit, method 150 proceeds to block 290 where the previously calculated long-term average EMF value is cleared from memory. The method 250 then ends at block 295. In essence, a determination that the average EMF value is not below the lower limit means that the speed of the motor is not below a lower speed limit.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A child swing, comprising:

a motor;

at least one swing arm;

a drive mechanism mechanically coupling the motor to the swing arm such that torque output by the motor imparts force on the swing arm; and a control system configured to monitor electromotive force (EMF) generated by the motor at an input signal line and configured to use the monitored EMF to control a speed of the motor to maintain a phase relationship between a phase of the drive mechanism and a phase of the at least one swing arm, wherein the control system is configured to use the monitored EMF to determine if the child swing has experienced a stall condition where arcuate motion of the swing arm has been disrupted.

2. The child swing of claim 1, wherein the motor initially operates at a predetermined speed and experiences variable loading conditions as a result of the mechanical coupling to the swing arm, and wherein the control system is configured to use the monitored EMF to detect changes in loading conditions and to adjust the speed of the motor in response to the changes in loading conditions such that the drive mechanism remains substantially in-phase with the swing arm such that phase changes of the drive mechanism, relative to the swing arm, lead to compensation of the swing.

3. The child swing of claim 1, wherein the control system is configured to drive the motor at the input signal line with a pulse width modulation (PWM) drive signal comprising a plurality of drive pulses, and wherein the control system is configured to adjust the duty cycle of the drive signal in response to the monitored EMF.

4. The child swing of claim 3, wherein to adjust the duty cycle of the drive signal in response to the monitored EMF, the control system is configured to:

store values corresponding to the EMF monitored from the input signal line for a period of time following a drive pulse;

calculate an average EMF value from the EMF values stored during the period of time; and use the average EMF value to select a new duty cycle for the drive signal.

5. The child swing of claim 1, wherein to determine if the child swing has experienced a stall condition, the control system is configured to:

store values corresponding to the EMF monitored from the input signal line for a period of time following each of a plurality of drive pulses;

for each of the plurality of drive pulses, calculate an average EMF value for the EMF values stored during the period of time following a corresponding drive pulse;

calculate, using the average EMF values calculated for each of the plurality of drive pulses, a long-term average EMF value; and compare the long-term average EMF value to upper and lower stall limits.

6. The child swing of claim 5, wherein if the long-term average EMF value is above the upper stall limit or below the lower stall limit, the control system is configured to enter a stabilization routine.

7. The child swing of claim 1, further comprising:

an analog-to-digital (A/D) converter configured to sample the input signal line and configured to provide the samples to the control system.

8. A control method for a child swing comprising:

driving a motor with a pulse width modulation (PWM) drive signal via an input signal line such that the motor imparts force to a swing arm mechanically coupled to the motor via a drive mechanism;

monitoring electromotive force (EMF) generated by the motor at the input signal line;

controlling the speed of the motor based on the monitored EMF to maintain a phase relationship between a phase of the drive mechanism and a phase of the at least one swing arm; and determining, based on the monitored EMF, if the child swing has experienced a stall condition where predetermined arcuate motion of the swing arm has been disrupted.

9. The method of claim 8, wherein the motor initially operates at a predetermined speed and experiences variable loading conditions as a result of the mechanical coupling to the swing arm, further comprising:

detecting, based on the monitored EMF, changes in loading conditions; and adjusting the speed of the motor in response to the detected changes in loading conditions such that the drive mechanism remains substantially in-phase with the swing arm.

10. The method of claim 8, further comprising:

driving the motor at the input signal line with a pulse width modulation (PWM) drive signal comprising a plurality of drive pulses; and adjusting the duty cycle of the drive signal in response to the monitored EMF.

11. The method of claim 8, wherein adjusting the duty cycle of the drive signal in response to the monitored EMF comprises:

storing values corresponding to the EMF monitored from the input signal line for a period of time following a drive pulse;

calculating an average EMF value from the EMF values stored during the period of time; and using the average EMF value to select a new duty cycle for the drive signal.

12. The method of claim 8, wherein determining if the child swing has experienced a stall condition comprises:

storing values corresponding to the EMF monitored from the input signal line for a period of time following each of a plurality of drive pulses;

for each of the plurality of drive pulses, calculating an average EMF value for the EMF values stored during the period of time following a corresponding drive pulse;

calculating, using the average EMF values calculated for each of the plurality of drive pulses, a long-term average EMF value; and comparing the long-term average EMF value to upper and lower stall limits.

13. The method of claim 12, wherein if the long-term average EMF value is above the upper stall limit or below the lower stall limit, further comprising:

initiating a stabilization routine.

14. The method of claim 8, wherein monitoring the EMF generated by the motor at the input signal line comprises:

sampling the input signal line with an analog-to-digital (A/D) converter.

15. One or more non-transitory computer readable storage media encoded with software comprising computer executable instructions, wherein the computer readable storage media is stored on a system, and when the software is executed by the system it is operable to:

drive a motor with a pulse width modulation (PWM) drive signal via an input signal line such that the motor imparts force to the system which is mechanically coupled to the motor via a drive mechanism;

monitor electromotive force (EMF) generated by the motor at the input signal line;

control the speed of the motor based on the monitored EMF to maintain a phase relationship between a phase of the drive mechanism relative to a phase of the at least one variable load system; and determine, based on the monitored EMF, if the system has experienced a stall condition where motion of the system has been disrupted.

16. The non-transitory computer readable storage media of claim 15, wherein the motor initially operates at a predetermined speed and experiences variable loading conditions as a result of the mechanical coupling to the system, and wherein the computer readable storage media further comprises instructions operable to:

detect, based on the monitored EMF, changes in loading conditions; and adjust the speed of the motor in response to the detected changes in loading conditions.

17. The non-transitory computer readable storage media of claim 15, further comprising instructions operable to:

drive the motor at the input signal line with a pulse width modulation (PWM) drive signal comprising a plurality of drive pulses; and adjust the duty cycle of the drive signal in response to the monitored EMF.

18. The non-transitory computer readable storage media of claim 17, wherein the instructions operable to adjust the duty cycle of the drive signal in response to the monitored EMF comprise instructions operable to:

store values corresponding to the EMF monitored from the input signal line for a period of time following a drive pulse;

calculate an average EMF value from the EMF values stored during the period of time; and use the offset value as a feedback control mechanism.

19. The non-transitory computer readable storage media of claim 15, wherein the instructions operable to determine if the system has experienced a stall condition comprise instructions operable to:

store values corresponding to the EMF monitored from the input signal line for a period of time following each of a plurality of drive pulses;

for each of the plurality of drive pulses, calculate an average EMF value for the EMF values stored during the period of time following a corresponding drive pulse;

calculate, using the average EMF values calculated for each of the plurality of drive pulses, a long-term average EMF value; and compare the long-term average EMF value to upper and lower stall limits.

20. The non-transitory computer readable storage media of claim 19, wherein if the long-term average EMF value is above the upper stall limit or below the lower stall limit, further comprising instructions operable to:

initiate a stabilization routine.

21. A controller for a child swing, comprising:

a memory; and a processor configured to:

drive a motor with a pulse width modulation (PWM) drive signal via an input signal line such that the motor imparts force to a swing arm via a drive mechanism;

monitor electromotive force (EMF) generated by the motor at the input signal line;

control the speed of the motor based on the monitored EMF to maintain a phase relationship between a phase of the drive mechanism and a phase of the swing arm; and determine, based on the monitored EMF, if the child swing has experienced a stall condition where arcuate motion of the swing arm has been disrupted.

22. The controller of claim 21, wherein the motor initially operates at a predetermined speed and experiences variable loading conditions as a result of the mechanical coupling to the swing arm, and wherein the processor is configured to:

detect, based on the monitored EMF, changes in loading conditions; and adjust the speed of the motor in response to the detected changes in loading conditions such that the drive mechanism remains substantially in-phase with the swing arm.

23. The controller of claim 21, wherein the processor is further configured to:

drive the motor at the input signal line with a pulse width modulation (PWM) drive signal comprising a plurality of drive pulses; and adjust the duty cycle of the drive signal in response to the monitored EMF.

24. The controller of claim 23, wherein to adjust the duty cycle of the drive signal in response to the monitored EMF, the processor is configure to:

store values corresponding to the EMF monitored from the input signal line for a period of time following a drive pulse;

calculate an average EMF value from the EMF values stored during the period of time;

subtract the average EMF value from a predetermined voltage value to generate an offset value; and use the offset value to select a new duty cycle for the drive signal.

25. The controller of claim 21, wherein to determine if the child swing has experienced a stall condition, the processor is configured to:

store values corresponding to the EMF monitored from the input signal line for a period of time following each of a plurality of drive pulses;

for each of the plurality of drive pulses, calculate an average EMF value for the EMF values stored during the period of time following a corresponding drive pulse;

calculate, using the average EMF values calculated for each of the plurality of drive pulses, a long-term average EMF value; and compare the long-term average EMF value to upper and lower stall limits.

26. The controller of claim 25, wherein if the long-term average EMF value is above the upper stall limit or below the lower stall limit, further comprising:

initiating a stabilization routine.

* * * * *